US006380664B1

(12) United States Patent
Pollner

(10) Patent No.: US 6,380,664 B1
(45) Date of Patent: Apr. 30, 2002

(54) SPARK PLUG HAVING AN INTERNAL CONDUCTOR CONFIGURATION

(75) Inventor: Rudolf Pollner, Bamberg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/446,499

(22) PCT Filed: Feb. 12, 1999

(86) PCT No.: PCT/DE99/00396

§ 371 Date: Dec. 21, 1999

§ 102(e) Date: Dec. 21, 1999

(87) PCT Pub. No.: WO99/56363

PCT Pub. Date: Nov. 4, 1999

(30) Foreign Application Priority Data

Apr. 24, 1998 (DE) ..... 198 18 214

(51) Int. Cl.[7] ..... H01J 13/20
(52) U.S. Cl. ..... 313/143 X; 313/118
(58) Field of Search ..... 313/143, 141, 313/118, 136, 135, 137, 140

(56) References Cited

U.S. PATENT DOCUMENTS 5,095,242 A * 3/1992 Richeson ..... 313/136
5,952,770 A * 9/1999 Mueller et al. ..... 313/136
6,160,342 A * 12/2000 Nishikawa et al. ..... 313/141

FOREIGN PATENT DOCUMENTS

| | | |
|---|---|---|
| DE | 44 31 143 | 3/1996 |
| DE | 196 23 989 | 1/1998 |
| DE | 196 36 537 | 3/1998 |
| JP | 05 152053 | 6/1993 |

* cited by examiner

*Primary Examiner*—Michael H. Day
*Assistant Examiner*—Joseph Williams
(74) *Attorney, Agent, or Firm*—Kenyon & Kenyon

(57) ABSTRACT

A spark plug having a tubular metallic housing in which an insulator is embedded, a rod-shaped internal conductor configuration being arranged in the insulator. The internal conductor configuration includes a terminal stud, a current-limiting resistor embedded in a conductive contact compound, a contact pin and a center electrode. The current-limiting resistor has two regions of unequal diameter. The diameter is smaller in the region nearer the combustion chamber than in the region farther from the combustion chamber.

2 Claims, 1 Drawing Sheet

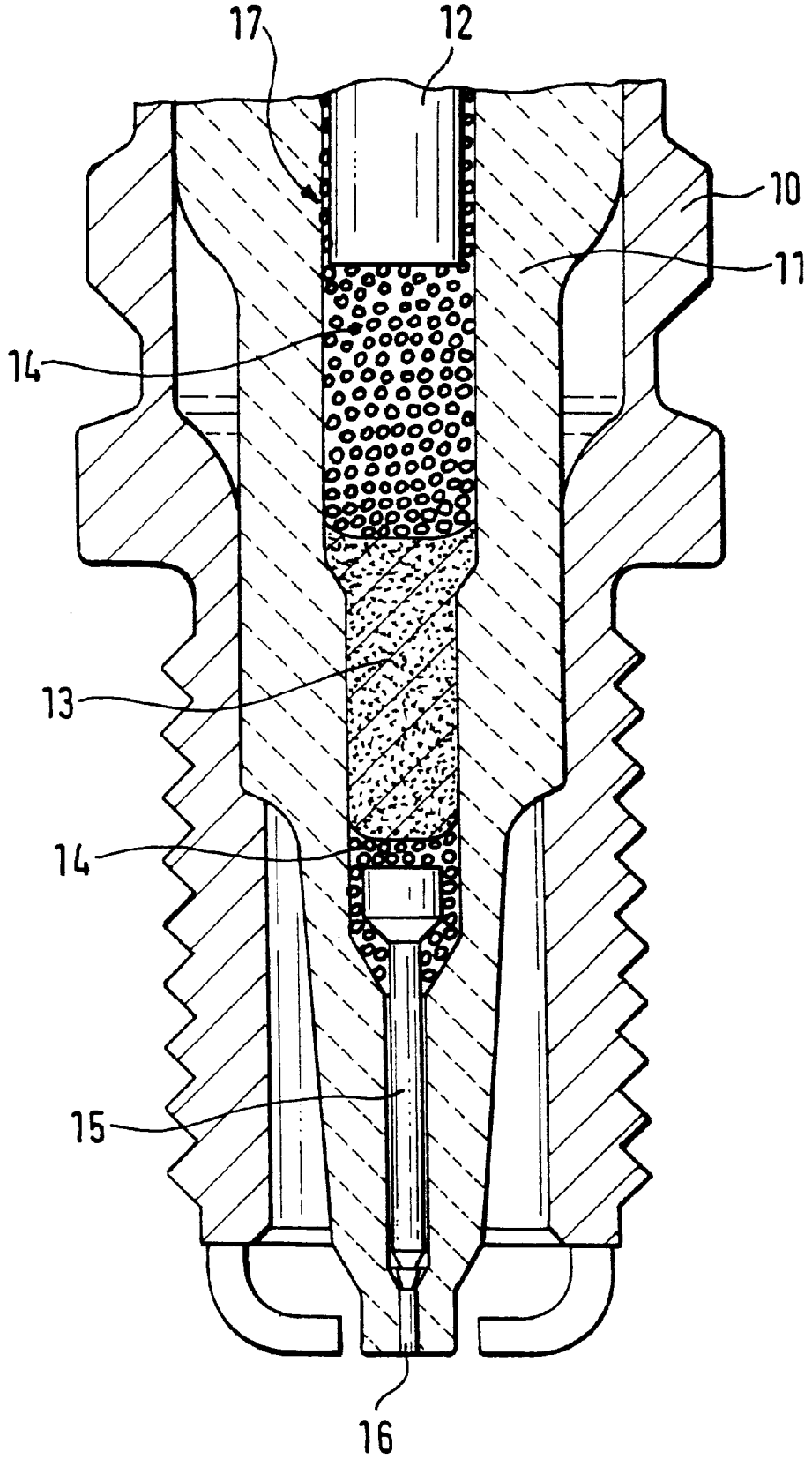
17
12
10
11
14
13
14
15
16

SPARK PLUG HAVING AN INTERNAL CONDUCTOR CONFIGURATION

BACKGROUND INFORMATION

German Patent No. 196 23 989 describes a spark plug having a tubular metallic housing in which an insulator is embedded, a rod-shaped internal conductor configuration being arranged in the insulator, the internal conductor configuration including a terminal stud, a current-limiting resistor, a coated contact pin and a nail-shaped platinum center electrode. Also attached to the housing are at least two, preferably four, ground electrodes, bent in toward the center electrode.

SUMMARY OF THE INVENTION

In comparison to known spark plugs, the advantage of the spark plug according to the present invention is that by sealing in the resistor in advance, spark pits in the ceramic are reduced and, thus, an adequate long-term stability and service life of the spark plug are given, accompanied by high spark energies and positive polarity of the ignition voltage. Important to the present invention in this case is that the resistor pack in the resistor seal has a larger cross-section on the terminal side facing away (farther away) from the combustion chamber than the resistor pack on the side facing (nearer) the combustion chamber. This has the advantage of providing a high stability with respect to capacitive stresses in the region of the electrodes, despite the spatial restriction and the use of a relatively small resistor pack.

The FIGURE shows the combustion-chamber end of the spark plug according to the present invention, with resistor pack.

DETAILED DESCRIPTION

The basic construction of a spark plug is described in, for example, German Patent No. 196 23 989 or German Patent No. 44 31 143, so that the construction need not be explained again here.

The FIGURE shows schematically, in sectional view, the combustion-chamber end of a spark plug. An insulator 11 is arranged in a tubular metallic housing 10, the axes of rotational symmetry of housing 10 and insulator 11 being coincident. Also arranged in insulator 11 are a terminal stud 12, a burnoff resistor 13 embedded in a conductive contact compound 14, a contact pin 15, and center electrode 16. In this embodiment of the present invention, the bore (cylindrical) hole of insulator 11, which accommodates the entire conductive central arrangement, is shaped such that insulator bore hole 17 has regions differing in diameter. These unequal diameters are conceived such that the diameter of insulator bore hole 17 is largest in the region of the terminal stud, while the diameter of the insulator bore hole is smallest at the combustion-chamber end. Thus, resistor pack 13 also has a larger cross section at the end of terminal stud 12 than at the electrode end. In the embodiment illustrated, the bore hole at the base is made with a diameter of approximately 3 mm, while the bore hole at the terminal stud end exhibits a diameter of approximately 4.6 mm. With this arrangement, the end of the resistor pack having the larger cross section is already situated outside the base region of the spark plug, so that no problems result from inadequate ceramic wall thickness.

Because of the spatial relationships in the base region of the spark plug, which represents the electrode end of the spark plug, the conductive contact compound, in which burnoff resistor 13 is sealed, must have a smaller diameter in the forward region. Because of the smaller diameter, the energy density in the resistor pack increases. To offset this increased energy density, resistor pack 13 has a larger diameter in the region facing away from the combustion chamber.

What is claimed is:

1. A spark plug associated with a combustion chamber, the spark plug comprising:

a tubular metallic housing;

an insulator embedded in the metallic housing; and a rod-shaped internal conductor configuration situated in the insulator, the internal conductor configuration including a terminal stud, a current-limiting resistor embedded in a conductive contact compound, a contact pin and a center electrode, the current-limiting resistor having at least first and second regions, the first region being on the side facing the combustion chamber and the second region being on the terminal side facing away from the combustion chamber, a first cross-section in the first region being smaller than a second cross-section in the second region.

2. The spark plug according to claim 1, wherein the second region is situated outside a base region of the spark plug.

* * * * *